US011542445B2

(12) United States Patent
Fathi et al.

(10) Patent No.: US 11,542,445 B2
(45) Date of Patent: Jan. 3, 2023

(54) CATALYST AND PROCESS OF UPGRADING HEAVY OIL IN THE PRESENCE OF STEAM

(71) Applicant: Saudi Arabian Oil Company, Dhahran (SA)

(72) Inventors: Mazin M. Fathi, Damman-Shula (SA); Ki-Hyouk Choi, Dhahran (SA); Mohammed R. Aldossary, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 23 days.

(21) Appl. No.: 17/397,234

(22) Filed: Aug. 9, 2021

(65) Prior Publication Data

US 2021/0363433 A1 Nov. 25, 2021

Related U.S. Application Data

(62) Division of application No. 16/720,238, filed on Dec. 19, 2019, now Pat. No. 11,118,121.

(51) Int. Cl.

| | |
|---|---|
| ***C10G 47/02*** | (2006.01) |
| ***C10G 47/32*** | (2006.01) |
| ***C10G 47/36*** | (2006.01) |

(52) U.S. Cl.

CPC ..... *C10G 47/02* (2013.01); *C10G 47/32* (2013.01); *C10G 47/36* (2013.01); (Continued)

(58) Field of Classification Search

None

See application file for complete search history.

(56) References Cited

U.S. PATENT DOCUMENTS 4,543,177 A * 9/1985 Murthy ..... C10G 9/00 208/72

5,688,741 A 11/1997 Carrazza et al.

(Continued)

FOREIGN PATENT DOCUMENTS

CN 108178179 A 6/2018

WO 2018007734 A1 1/2018

OTHER PUBLICATIONS

Beletskaya, et al., Aqueous transition-metal catalysis. In Organic Synthesis in Water, Springer: 1998; pp. 141-222.

(Continued)

*Primary Examiner* — Tam M Nguyen

(74) *Attorney, Agent, or Firm* — Bracewell LLP; Constance G. Rhebergen; Eleanor L. Tyson

(57) ABSTRACT

Embodiments of the disclosure provide an aqueous reforming system and a method for upgrading heavy hydrocarbons. A hydrocarbon feed and a surfactant stream are combined to produce a first precursor stream. The first precursor stream and an alkali feed are combined to produce a second precursor stream. The second precursor stream and a transition metal feed are combined to produce a catalytic emulsion stream. The catalytic emulsion stream is heated to produce a catalytic suspension and a decomposition gas, where the decomposition gas is separated by a first separator. The catalytic suspension is combined with a preheated water stream to produce an aqueous reformer feed. The aqueous reformer feed is introduced to an aqueous reformer such that the heavy hydrocarbons undergo conversion reactions to produce an effluent stream. The effluent stream is introduced to a second separator to produce a heavy stream and a light stream. The light stream is introduced to a third separator to produce a gas stream, a distillate stream, and a spent water stream. Optionally, a portion of the distillate stream and the (Continued)

hydrocarbon feed can be combined to produce the first precursor stream such that the first precursor stream is in the absence of a surfactant.

18 Claims, 1 Drawing Sheet

(52) U.S. Cl.
CPC ..... *C10G 2300/107* (2013.01); *C10G 2300/1077* (2013.01); *C10G 2300/4006* (2013.01); *C10G 2300/4012* (2013.01); *C10G 2300/805* (2013.01); *C10G 2400/04* (2013.01)

(56) References Cited

U.S. PATENT DOCUMENTS

| | | | | |
|---|---|---|---|---|
| 5,885,441 | A | 3/1999 | Pereira et al. | |
| 6,630,293 | B1 * | 10/2003 | Kuno | C07C 51/412 430/631 |
| 7,585,406 | B2 | 9/2009 | Khadzhiev et al. | |
| 8,231,857 | B2 | 7/2012 | Cortright et al. | |
| 8,551,907 | B2 | 10/2013 | Pereira et al. | |
| 9,018,124 | B2 | 4/2015 | Mironov et al. | |
| 9,169,449 | B2 | 10/2015 | Reynolds et al. | |
| 9,562,199 | B2 | 2/2017 | Pereira Almao et al. | |
| 2007/0161505 | A1 | 7/2007 | Pereira-Almao et al. | |
| 2009/0260824 | A1 * | 10/2009 | Burns | E21B 21/00 166/57 |
| 2013/0048540 | A1 | 2/2013 | Noguera Herrera et al. | |
| 2014/0109465 | A1 * | 4/2014 | Coppola | C10G 45/68 422/187 |
| 2018/0086990 | A1 | 3/2018 | Pereira Almao et al. | |
| 2018/0155642 | A1 * | 6/2018 | Al-Ghamdi | C10G 69/08 |
| 2021/0189261 | A1 * | 6/2021 | Fathi | C10G 11/02 |

OTHER PUBLICATIONS

Chandradass, et al., Nano-LaFeO3 Powder Preparation by Calcining an Emulsion Precursor, Materials Chemistry and Physics, vol. 122, Issues 2-3, Aug. 1, 2010, pp. 329-332.
Coronado, et al., A Review of Catalytic Aqueous-Phase Reforming of Oxygenated Hydrocarbons Derived from Biorefinery Water Fractions, International Journal of Hydrogen Energy, vol. 41, Issue 26, Jul. 13, 2016, pp. 11003-11032.
Davda,et al.,A Review of Catalytic Issue and Process Conditions for Renewable Hydrogen and Alkanes by Aqueous-Phase Reforming of Oxygenated Hydrocarbons Over Supported Metal Catalysts,Applied Catalysis B:Environmental vol. 56, Issues 1-2, 2005, 171-186.
Escalona, et al., Nanometric Bimetallic Sulfides Prepared via Thermal Decomposition of Ni and Fe heteropolymolybdate emulsions, Catalysis Letters, Dec. 2006, vol. 112, Issue 3-4, pp. 227-230.
Fathi, et al., Catalytic Aquaprocessing of Arab Light Vacuum Residue via Short Space Times. Energy Fuels 2011, 25 (11), 4867.
Kadieva, et al., Synthesis of Nanosized Particles of Components of Petroleum Refining Catalysts in a hydrocarbon Medium from Inverted Microemulsions, Petroleum Chemistry, Nov. 2011, vol. 51, Issue 6, pp. 426-434.
Marzin, et al., Resid Conversion Through the Aquaconversion™ Technology—An Economical and Environmental Solution. 1998.
Thiel, The interaction of water with solid surfaces: Fundamental aspects. Surface Science Reports 1987, 7 (6-8), 211-385.
Vitorino, et al., Cellular MgAl2O4 Spinels Prepared by Reactive Sintering of Emulsified Suspensions, Materials Letters, vol. 164, Feb. 1, 2016, pp. 190-193.
Wang, et al. Mechanism of catalytic aquathermolysis: influences on heavy oil by two types of efficient catalytic ions Fe3+ and Mo6+. Energy & Fuels, 2010, 24 (3), 1502-1510.

* cited by examiner

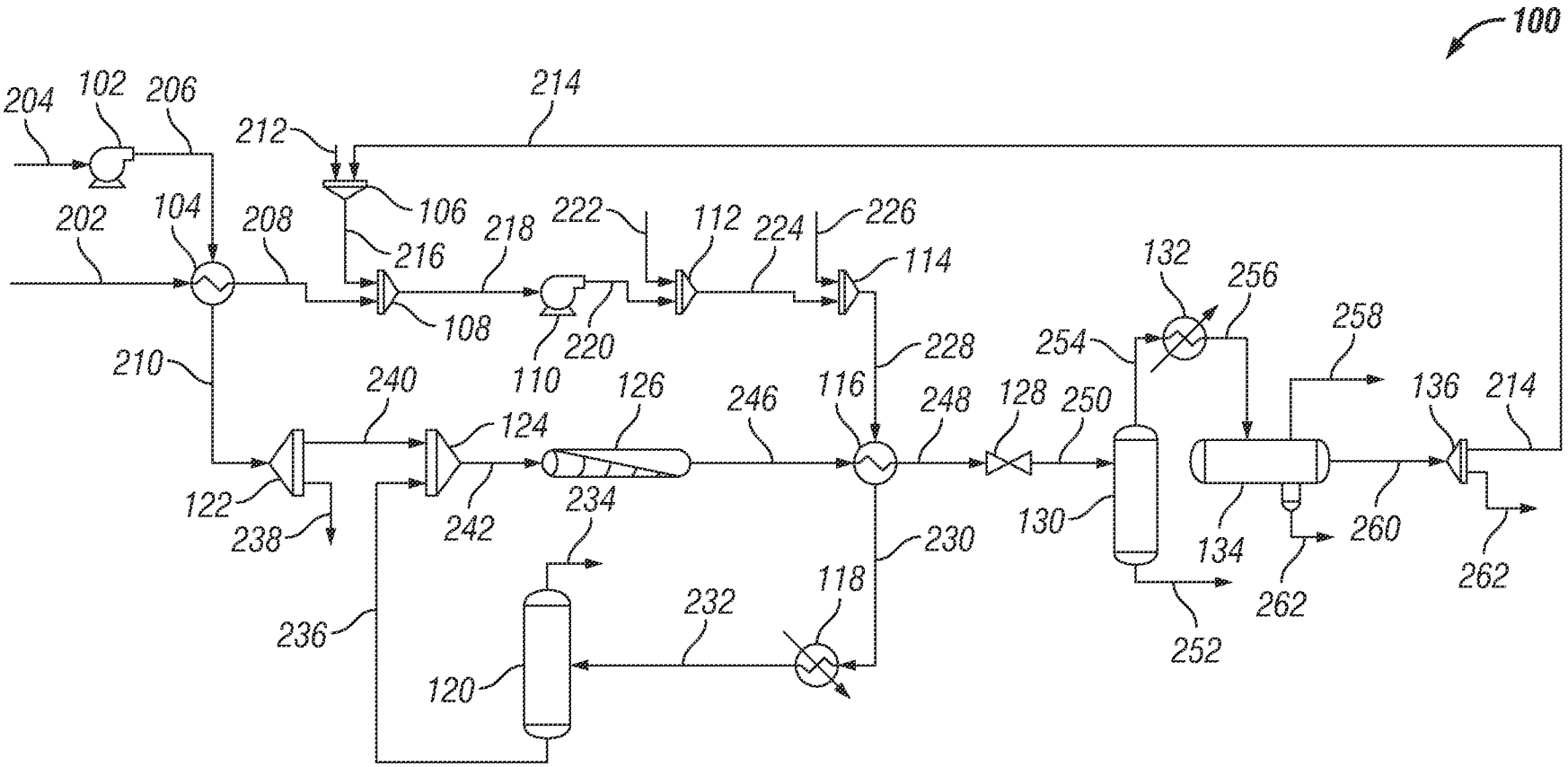
100
214
262
136
260
258
262
256
134
132
252
254
250
130
128
228
248
230
114
226
116
118
224
246
112
232
222
126
220
234
110
124
218
242
120
108
106
216
240
236
212
208
238
122
206
104
210
102
202
204

CATALYST AND PROCESS OF UPGRADING HEAVY OIL IN THE PRESENCE OF STEAM

CROSS-REFERENCE TO RELATED APPLICATIONS

This patent application is a divisional of U.S. Non-Provisional patent application Ser. No. 16/720,238 filed on Dec. 19, 2019 now U.S. Pat. No. 11,118,121. For purposes of United States patent practice, the non-provisional application is incorporated by reference in its entirety.

BACKGROUND

Field of the Disclosure

Embodiments of the disclosure generally relate to hydrocarbon processing. More specifically, embodiments of the disclosure relate to a method and system for utilizing a catalyst for aqueous reforming to process hydrocarbons.

DESCRIPTION OF THE RELATED ART

Water is commonly used in non-catalytic steam cracking reactions such as aquathermolysis. Water is an amphoteric compound capable of acting as an acid or base in acid or base catalysis. The self-ionization of water can be exploited in these processes to saturate free radicals of produced hydrocarbons. However, the self-ionization of water is suppressed as the temperature increases which may negatively affect the efficiency of cracking and upgrading heavy hydrocarbon residua. Water molecules self-dissociate into hydronium and hydroxide ions at any given temperature and pressure according to the following equilibrium reaction:

$$2H_2O(l) \leftrightarrow OH^-(aq) + H_3O^+(aq).$$

The extent of self-ionization of water depends on temperature and pressure. The density and molecular structure of water change in saturation conditions. For example, liquid water in ambient conditions has a tetrahedral molecular structure where the central oxygen atom is covalently bonded by two hydrogen atoms and interacts with two additional hydrogen atoms from adjacent water molecules via hydrogen bonding. However, at increased temperature (such as the boiling point or the critical point) and constant pressure, such tetrahedral structure of water collapses. The increase or decrease of the ionic product of water, $K_w$, is a measure of the extent of water dissociation into ions. At constant pressure, the $K_w$ of saturated water increases as the temperature increases up to a point where the $K_w$ starts to decrease as the temperature approaches the critical point of water, where there is a rapid decrease in density. Unlike the temperature dependence of the $K_w$, at constant temperature, the $K_w$ of saturated water generally increases as the pressure increases.

Water is a polar solvent and has a dielectric constant of 80 at standard temperature and pressure (SATP). However, the dielectric constant of water falls to about less than eight as the temperature increases up to the critical point. Without being bound by any theory, this is due to the decrease in the degree of hydrogen bonding in water as the temperature increases. At temperatures greater than 100 deg. C., the dielectric constant of water drops to less than 55 where polar characteristics of water are reduced. Consequently, water at temperatures greater than its boiling point is miscible in a nonpolar hydrocarbon-based medium. Water at supercritical conditions is a fluid that retains those properties such that it exhibits a polar fluid-like behavior. These characteristics of supercritical water under moderate to high pressures enables water to exhibit miscible behavior in nonpolar hydrocarbon-based medium and also associate with the polar fraction of the hydrocarbon feed such as asphaltenes, catalytic and metal particulates as the water conditions divert from the supercritical point.

Water-based chemical reactions typically involve the main reactant being somewhat solubilized in water. For example, when oil is used as the main reactant in a catalysis reaction involving an aqueous catalyst dissolved in water, it is generally necessary to homogenize the oil phase and the catalyst-containing water phase to conduct the catalysis reaction. A water-oil miscible agent such as a surfactant is typically used for homogenization, where a microemulsion can be formed due to the dual hydrophilic-lipophilic nature of the surfactant. The microemulsion features an interfacial layer, at which the aqueous catalyst and the oil interpenetrate each other and react.

The use of aqueous means is known as an effective technique for upgrading heavy hydrocarbons. Water is known to promote the upgrading process at a supercritical phase as demonstrated by catalytic aqueous reforming. Here, water undergoes homolytic splitting (that is, producing free radicals of hydrogen, hydroxyl, or oxygen) to reduce the rate of asphaltene formation through catalytic hydrogen transfer from water to oil. During aqueous reforming, reactions such as cracking, hydrogen transfer/abstraction, reforming, and isomerization may take place. At thermal cracking conditions, it is known that homolytic splitting of water is less energy demanding than heterolytic splitting of water (that is, producing hydrogen cations, hydroxide anions, or oxygen anions), such that water is expected to undergo catalytic dissociation via a radical mechanism at such conditions.

One example of aqueous reforming is Aquaconversion™, where water and an ultradispersed catalyst is added to the conventional visbreaking process. Heavy hydrocarbons are upgraded by combining thermal, steam, and catalytic processes in one integrated process allowing water to dissociate such that hydrogen radicals can be added to and react with thermally cracked hydrocarbon radicals.

SUMMARY

Embodiments of the disclosure generally relate to hydrocarbon processing. More specifically, embodiments of the disclosure relate to a method and system for utilizing a catalyst for aqueous reforming to process hydrocarbons.

The major constituent of heavy hydrocarbon oils such as short residua cracks at temperatures greater than the critical temperature of water. Because the self-ionization of water, at a constant pressure, decreases as the critical temperature is approached, it is expected that the self-splitting of water at heavy oil upgrading temperatures is improbable unless high pressures are employed. To overcome this difficulty, a highly dispersed, aqueous, homogeneous catalyst can be utilized to promote water splitting at low to moderate pressures in the range of 260 pounds per square inch (psi) to 1,000 psi. The highly dispersed, aqueous catalyst alleviates water dissociation via a free radical mechanism. Furthermore, the catalyst particulates facilitate the addition of hydrogen and oxygen radicals to thermally generated hydrocarbon free radicals, reduce asphaltenes, and prevent coke formation.

Embodiments of the disclosure includes a reaction sequence the proceeds by catalytic partial or total, dissociation of water into hydrogen radicals, hydroxyl radicals, or oxygen radicals. Utilization of highly dispersed, aqueous catalyst at residua upgrading temperatures promotes additional water dissociation via a free radical mechanism. Whether or not there is a hydrogen source, the highly dispersed, aqueous catalyst promotes hydrogen addition reactions to the hydrocarbon free radicals. Compared to supported catalyst matrices, the highly dispersed, aqueous catalytic particulates provide reduced diffusion control and improved effective contact between water, oil, hydrogen, and the catalyst particulates.

Embodiments of the disclosure are drawn to a system and method to generate a highly dispersed aqueous catalyst and an in situ generated surfactant to reduce asphaltenes and coke generation during heavy oil upgrading. The highly dispersed, catalytic particulates do not require support, such that diffusion control can be minimized in comparison to a supported catalyst. The submicronic scale of the catalyst allows a greater degree of dispersion, provides a greater degree of accessible active sites, and improves contact time, in reduced catalyst concentrations in the range of a few parts per million (ppm). Utilizing a catalyst in the submicronic scale eliminates the potential for heat gradient build up. The highly dispersed catalyst at least partially dissociates water into free oxygen and hydrogen radicals. Moreover, the catalyst also promotes hydrogen addition to free radicals of the thermally cracked oil thereby reducing asphaltenes and polycyclic aromatics, and preventing free radical association and hydrogen abstraction reactions.

Embodiments of the disclosure provide a method for upgrading heavy hydrocarbons. The method includes the step of combining a hydrocarbon feed and a surfactant stream to produce a first precursor stream. The hydrocarbon feed includes the heavy hydrocarbons. The surfactant stream includes a surfactant. The method includes the step of combining the first precursor stream and an alkali feed to produce a second precursor stream. The alkali feed includes an alkali metal and water. The method includes the step of combining the second precursor stream and a transition metal feed to produce a catalytic emulsion stream. The transition metal feed includes a transition metal and water. The catalytic emulsion stream includes an emulsion including the heavy hydrocarbons, the alkali metal, the transition metal, the surfactant, and water. The method includes the step of heating the catalytic emulsion stream to a first temperature such that the surfactant is decomposed producing a suspension and a decomposition gas. The suspension includes the heavy hydrocarbons, the alkali metal, and the transition metal. The method includes the step of introducing the suspension and the decomposition gas to a first separator producing a catalytic suspension stream and a decomposition gas stream. The catalytic suspension stream includes the suspension. The catalytic suspension stream is substantially in the absence of water. The decomposition gas stream includes the decomposition gas and water. The method includes the step of combining the catalytic suspension stream and a preheated water stream to produce an aqueous reformer feed. The method includes the step of introducing the aqueous reformer feed to an aqueous reformer such that the heavy hydrocarbons undergo conversion reactions to produce an effluent stream. The effluent stream includes upgraded hydrocarbons. The method includes the step of introducing the effluent stream to a second separator to produce a heavy stream and a light stream. The heavy stream includes hydrocarbons having a true boiling point greater than that of the light stream. The method includes the step of introducing the light stream to a third separator to produce a gas stream, a distillate stream, and a spent water stream.

In some embodiments, a portion of the distillate stream is combined with the hydrocarbon feed and the surfactant stream to produce the first precursor stream. In some embodiments, the first precursor stream has a surfactant content ranging between 0.0001 wt. % and 0.05 wt. %.

In some embodiments, the heavy hydrocarbons include an atmospheric residue fraction, a vacuum residue fraction, and combinations thereof.

In some embodiments, the method further includes the step of pressurizing the first precursor stream to a first pressure ranging between 18 bar and 20 bar.

In some embodiments, the alkali feed has an alkali metal concentration ranging between 500 ppm and 1,000 ppm. In some embodiments, the transition metal feed has a transition metal concentration ranging between 100 ppm and 500 ppm.

In some embodiments, the catalytic emulsion stream has a water content ranging between 3 wt. % and 8 wt. % of the heavy hydrocarbons included therein. In some embodiments, the catalytic emulsion stream has an alkali metal-to-transition metal ratio ranging between 5:1 and 2:1.

In some embodiments, the first temperature ranges between 390 deg. C. and 430 deg. C. In some embodiments, the preheated water is under supercritical conditions of water.

In some embodiments, the aqueous reformer feed has a temperature ranging between 390 deg. C. and 450 deg. C. In some embodiments, the aqueous reformer feed has a water content ranging between 3 wt. % and 8 wt. % of the heavy hydrocarbons included therein.

In some embodiments, the method further includes the step of cooling the effluent stream to a second temperature ranging between 340 deg. C. and 360 deg. C. In some embodiments, the method further includes the step of depressurizing the effluent stream to a second pressure ranging between 1 bar and 3 bar.

In some embodiments, the heavy stream includes an atmospheric residue fraction, a vacuum residue fraction, and combinations thereof. In some embodiments, the light stream comprises a distillate fraction, a gas fraction, and water.

In some embodiments, the method further includes the step of cooling the light stream to a third temperature ranging between 30 deg. C. and 50 deg. C.

In some embodiments, the distillate stream includes a diesel fraction, a kerosene fraction, a heavy naphtha fraction, a light naphtha fraction, and combinations thereof.

Embodiments of the disclosure also provide an aqueous reforming system for upgrading heavy hydrocarbons. The aqueous reforming system includes a first mixer, a second mixer, a third mixer, a heater, a first separator, a fourth mixer, an aqueous reformer, a second separator, and a third separator. The first mixer is configured to combine a hydrocarbon feed and a surfactant stream to produce a first precursor stream. The hydrocarbon feed includes the heavy hydrocarbons. The surfactant stream includes a surfactant. The second mixer is fluidly connected downstream of the first mixer. The second mixer configured to combine the first precursor stream and an alkali feed to produce a second precursor stream. The alkali feed comprises an alkali metal and water. The third mixer is fluidly connected downstream of the second mixer. The third mixer is configured to combine the second precursor stream and a transition metal feed to produce a catalytic emulsion stream. The transition metal feed includes a transition metal and water. The catalytic emulsion stream includes an emulsion including the heavy hydrocarbons, the alkali metal, the transition metal, the surfactant, and water. The heater is fluidly connected downstream of the third mixer. The heater is configured to heat the catalytic emulsion stream to a first temperature ranging between 390 deg. C. and 430 deg. C. such that the surfactant is decomposed producing a suspension and a decomposition gas. The suspension includes the heavy hydrocarbons, the alkali metal, and the transition metal. The first separator is fluidly connected downstream of the heater. The first separator is configured to produce a catalytic suspension stream and a decomposition gas stream. The catalytic suspension stream includes the suspension. The catalytic suspension stream is substantially in the absence of water. The decomposition gas stream includes the decomposition gas and water. The fourth mixer is fluidly connected downstream of the first separator. The fourth mixer is configured to combine the catalytic suspension stream and a preheated water stream to produce an aqueous reformer feed. The aqueous reformer is fluidly connected downstream of the fourth mixer. The aqueous reformer is configured to allow the heavy hydrocarbons to undergo conversion reactions at a second temperature ranging between 390 deg. C. and 450 deg. C. to produce an effluent stream. The effluent stream includes upgraded hydrocarbons. The second separator is fluidly connected downstream of the aqueous reformer. The second separator is configured to separate the effluent stream to produce a heavy stream and a light stream. The heavy stream includes hydrocarbons having a true boiling point greater than that of the light stream. The third separator is fluidly connected downstream of the second separator. The third separator is configured to separate the light stream to produce a gas stream, a distillate stream, and a spent water stream.

In some embodiments, the aqueous reforming system further includes a splitter. The splitter is fluidly connected downstream of the third separator and upstream of the first mixer. The splitter is configured to separate a portion of the distillate stream. The portion of the distillate stream is combined with the hydrocarbon feed and the surfactant stream to produce the first precursor stream.

In some embodiments, the aqueous reforming system further includes a pump. The pump is fluidly connected downstream of the first mixer and upstream of the second mixer. The pump is configured to pressurize the first precursor stream to a first pressure ranging between 15 bar and 20 bar.

In some embodiments, the aqueous reforming system further includes a pressure reducer. The pressure reducer is fluidly connected downstream of the aqueous reformer and upstream of the second separator. The pressure reducer is configured to depressurize the effluent stream to a second pressure ranging between 1 bar and 3 bar.

In some embodiments, the aqueous reforming system further includes a heat exchanger. The heat exchanger is fluidly connected downstream of the second separator and upstream of the third separator. The heat exchanger is configured to cool the light stream to a third temperature ranging between 30 deg. C. and 50 deg. C.

BRIEF DESCRIPTION OF THE DRAWINGS

So that the manner in which the previously-recited features, aspects, and advantages of the embodiments of this disclosure as well as others that will become apparent are attained and can be understood in detail, a more particular description of the disclosure briefly summarized previously may be had by reference to the embodiments that are illustrated in the drawings that form a part of this specification. However, it is to be noted that the appended drawings illustrate only certain embodiments of the disclosure and are not to be considered limiting of the disclosure's scope as the disclosure may admit to other equally effective embodiments.

FIGURE is a schematic diagram of a process for aqueous reforming according to an embodiment of the disclosure.

In the accompanying FIGURE, similar components or features, or both, may have a similar reference label.

DETAILED DESCRIPTION

The disclosure refers to particular features, including process or method steps and systems. Those of skill in the art understand that the disclosure is not limited to or by the description of embodiments given in the specification. The subject matter of this disclosure is not restricted except only in the spirit of the specification and appended claims.

Those of skill in the art also understand that the terminology used for describing particular embodiments does not limit the scope or breadth of the embodiments of the disclosure. In interpreting the specification and appended claims, all terms should be interpreted in the broadest possible manner consistent with the context of each term. All technical and scientific terms used in the specification and appended claims have the same meaning as commonly understood by one of ordinary skill in the art to which this disclosure belongs unless defined otherwise.

Although the disclosure has been described with respect to certain features, it should be understood that the features and embodiments of the features can be combined with other features and embodiments of those features.

Although the disclosure has been described in detail, it should be understood that various changes, substitutions, and alternations can be made without departing from the principle and scope of the disclosure. Accordingly, the scope of the present disclosure should be determined by the following claims and their appropriate legal equivalents.

As used throughout the disclosure, the singular forms "a," "an," and "the" include plural references unless the context clearly indicates otherwise.

As used throughout the disclosure, the word "about" includes +/−5% of the cited magnitude. The word "substantially" includes +/−5% of the cited magnitude.

As used throughout the disclosure, the words "comprise," "has," "includes," and all other grammatical variations are each intended to have an open, non-limiting meaning that does not exclude additional elements, components or steps. Embodiments of the present disclosure may suitably "comprise," "consist," or "consist essentially of" the limiting features disclosed, and may be practiced in the absence of a limiting feature not disclosed. For example, it can be recognized by those skilled in the art that certain steps can be combined into a single step.

As used throughout the disclosure, the words "optional" or "optionally" means that the subsequently described event or circumstances can or may not occur. The description includes instances where the event or circumstance occurs and instances where it does not occur.

Where a range of values is provided in the specification or in the appended claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended claims to a method comprising two or more defined steps, the defined steps can be carried out in any order or simultaneously except where the context excludes that possibility.

As used throughout the disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

As used throughout the disclosure, spatial terms described the relative position of an object or a group of objects relative to another object or group of objects. The spatial relationships apply along vertical and horizontal axes. Orientation and relational words are for descriptive convenience and are not limiting unless otherwise indicated.

As used throughout the disclosure, the term "external supply of hydrogen" refers to the addition of hydrogen to the feed to the reactor or to the reactor itself. For example, a reactor in the absence of an external supply of hydrogen means that the feed to the reactor and the reactor are in the absence of added hydrogen such that no hydrogen is a feed or a part of a feed to the reactor.

As used throughout the disclosure, the term "external supply of catalyst" refers to the addition of catalyst to the feed to the reactor or the presence of a catalyst in the reactor, such as a fixed bed catalyst in the reactor. For example, a reactor in the absence of an external supply of catalyst means no catalyst has been added to the feed to the reactor and the reactor does not contain a catalyst bed in the reactor.

As used throughout the disclosure, the terms "atmospheric residue" or "atmospheric residue fraction" refer to the fraction of oil-containing streams having an initial boiling point (IBP) of 340 deg. C., such that all of the hydrocarbons have boiling points greater than 340 deg. C. and includes the vacuum residue fraction. Atmospheric residue can refer to the composition of an entire stream, such as when the feedstock is from an atmospheric distillation unit, or can refer to a fraction of a stream, such as when a whole range crude is used.

As used throughout the disclosure, the terms "vacuum residue" or "vacuum residue fraction" refer to the fraction of oil-containing streams having an IBP of 540 deg. C. Vacuum residue can refer to the composition of an entire stream, such as when the feedstock is from a vacuum distillation unit or can refer to a fraction of stream, such as when a whole range crude is used.

As used throughout the disclosure, the term "asphaltene" refers to the fraction of an oil-containing stream which is not soluble in a n-alkane, particularly, n-heptane.

As used throughout the disclosure, the terms "heavy hydrocarbon," "heavy hydrocarbon fraction," or "heavy fraction" refer to the fraction in the petroleum feed having a true boiling point (TBP) 10% that is equal to or greater than about 340 deg. C., or alternately equal to or greater than about 540 deg. C. In at least one embodiment, the heavy fraction has a TBP 10% that is equal to or greater than about 540 deg. C. Examples of a heavy fraction can include the atmospheric residue fraction or vacuum residue fraction. The heavy fraction can include components from the petroleum feed that were not converted in a supercritical water reactor. The heavy fraction can also include hydrocarbons that were dimerized or oligomerized in the supercritical water reactor due to either lack of hydrogenation or resistance to thermal cracking.

As used throughout the disclosure, the terms "light hydrocarbon," "light hydrocarbon fraction," or "light fraction" refer to the fraction in the petroleum feed that is not considered the heavy fraction. For example, when the heavy fraction refers to the fraction having a TBP 10% that is equal to or greater than about 340 deg. C. the light fraction has a TBP 90% that is less than about 340 deg. C. For example, when the heavy fraction refers to the fraction having a TBP 10% equal to or greater than about 540 deg. C. the light fraction has a TBP 90% that is less than about 540 deg. C.

As used throughout the disclosure, the term "gas fraction" refers to a hydrocarbon fraction that exists in gas phase at SATP.

As used throughout the disclosure, the terms "distillate fraction" or "distillate" refer to a hydrocarbon fraction lighter than the distillation residue from an atmospheric distillation process or a vacuum distillation process, and heavier than the gas fraction. For example, the distillate fraction can include a diesel fraction, a kerosene fraction, a heavy naphtha fraction, and a light naphtha fraction.

As used throughout the disclosure, the terms "diesel fraction" or "diesel" refer to a hydrocarbon fraction having a TBP 10% of about 230 deg. C. and a TBP 90% of about 340 deg. C.

As used throughout the disclosure, the terms "kerosene fraction" or "kerosene" refer to a hydrocarbon fraction having a TBP 10% of about 180 deg. C. and a TBP 90% of about 230 deg. C.

As used throughout the disclosure, the terms "heavy naphtha fraction" or "heavy naphtha" refer to a hydrocarbon fraction having a TBP 10% of about 90 deg. C. and a TBP 90% of about 180 deg. C.

As used throughout the disclosure, the terms "light naphtha fraction" or "light naphtha" refer to a hydrocarbon fraction having a TBP 10% of about 30 deg. C. and a TBP 90% of about 90 deg. C.

As used throughout the disclosure, the term "naphtha fraction" or "naphtha" can include both heavy naphtha and light naphtha.

As used throughout the disclosure, the term "coke" refers to the toluene insoluble material present in petroleum.

As used throughout the disclosure, the term "cracking" refers to the breaking of hydrocarbons into smaller ones containing few carbon atoms due to the breaking of carbon-carbon bonds.

As used throughout the disclosure, the term "upgrade" means one or all of increasing API gravity, decreasing the amount of impurities, such as sulfur, nitrogen, and metals, decreasing the amount of asphaltenes, and increasing the amount of distillate in a process outlet stream relative to the process feed stream. One of skill in the art understands that upgrade can have a relative meaning such that a stream can be upgraded in comparison to another stream, but can still contain undesirable components such as impurities. Such upgrading results in increase of API gravity, shifting distillation curve to lower temperature, decrease of asphalthenes content, decrease of viscosity, and increase of light fractions such as naphtha and diesel.

As used throughout the disclosure, the term "conversion reaction" refers to one or more reactions that can upgrade a hydrocarbon stream including cracking, isomerization, alkylation, dimerization, aromatization, cyclization, desulfurization, denitrogenation, deasphalting, and demetallization.

As used throughout the disclosure, the term "emulsion" refers to a fluid system in which liquid droplets of a certain liquid are dispersed in another liquid that is immiscible.

As used throughout the disclosure, the term "suspension" refers to a fluid system in which metal particulates are dispersed in a certain liquid.

Embodiments of the disclosure provide an aqueous reforming system for upgrading heavy hydrocarbons. Embodiments of the disclosure also provide an in situ continuous flow catalyst preparation method for aqueous reforming of heavy hydrocarbons.

FIGURE shows a schematic diagram of a process 100 involving the aqueous reforming system, according to an embodiment of the disclosure. The aqueous reforming system can include pump 102, heat exchanger 104, mixer 106, mixer 108, pump 110, mixer 112, mixer 114, heat exchanger 116, heater 118, separator 120, splitter 122, mixer 124, aqueous reformer 126, pressure reducer 128, separator 130, heat exchanger 132, separator 134, and splitter 136.

Hydrocarbon feed 202 is introduced to the aqueous reforming system. Hydrocarbon feed 202 can be any heavy hydrocarbon source derived from petroleum, coal liquid, or biomaterials. Non-limiting examples of hydrocarbon feed 202 can include whole range crude oil, distilled or reduced crude oil, residue oil, atmospheric distillates, atmospheric residue, vacuum distillates, vacuum residue, vacuum gas oil, deasphalted oil, topped crude oil, refinery streams, product streams from steam cracking processes, liquefied coals, liquid products recovered from oil or tar sands, bitumen, oil shale, asphalthenes, liquid hydrocarbons recovered from gas-to-liquid (GTL) processes, and biomass derived hydrocarbons (such as vegetable oil). In at least one embodiment, hydrocarbon feed 202 can include an atmospheric residue, a vacuum residue, vacuum gas oil, and deasphalted oil (DAO). In at least one embodiment, hydrocarbon feed 202 can include a vacuum residue. "Whole range crude oil" refers to passivated crude oil which has been processed by a gas-oil separation plant after being recovered from a production well. "Topped crude oil" can also be known as "reduced crude oil" and refers to a crude oil having no light fraction, and would include an atmospheric residue stream or a vacuum residue stream. "Refinery streams" can include "cracked oil," such as light cycle oil, heavy cycle oil, Coker gas oil, and streams from a fluid catalytic cracking unit (FCC), such as slurry oil or decant oil, heavy stream from hydrocracker with a boiling point greater than about 340 deg. C., DAO stream from a solvent extraction process, and a mixture of atmospheric residue and hydrocracker bottom fractions. Hydrocarbon feed 202 is introduced to the aqueous reforming system at a liquid hourly space velocity ranging between about 0.1 inverse hours ($hr^{-1}$) and about 10 $hr^{-1}$, alternately between about 2.5 $hr^{-1}$ and about 7 $hr^{-1}$, or alternately between about 6 $hr^{-1}$ and about 7 $hr^{-1}$. In at least one embodiment, hydrocarbon feed 202 is introduced to the aqueous reforming system at a liquid hourly space velocity of about 6.5 $hr^{-1}$. Hydrocarbon feed 202 can have an API gravity ranging between about −2 and about 38. Hydrocarbon feed 202 can have an asphaltene content ranging between about 0.2 wt. % and about 27 wt. %. Hydrocarbon feed 202 can have a total sulfur content ranging between 0.5 wt. % and about 7 wt. %. Hydrocarbon feed 202 can have a vacuum residue content ranging between 1 wt. % and about 90 wt. %. The temperature of hydrocarbon feed 202 can range between about 80 deg. C. and about 370 deg. C., alternately between about 90 deg. C. and about 300 deg. C., or alternately between about 120 deg. C. and about 360 deg. C.

Water feed 204 is introduced to the aqueous reforming system. Water feed 204 can be demineralized water. The conductivity of water feed 204 can be less than about 1.0 microSiemens per centimeter (S/cm), alternately less than about 0.5 S/cm, or alternately less than about 0.1 S/cm. In at least one embodiment, the conductivity of water feed 204 is less than about 0.2 S/cm. The sodium content of water feed 204 can be less than about 10 micrograms per liter (μg/L), alternately less than about 5 μg/L, or alternately less than about 2 μg/L. In at least one embodiment, the sodium content of water feed 204 ranges between about 0.1 μg/L and about 2.0 μg/L. The chloride content of water feed 204 can be less than about 5 μg/L, alternately less than about 3 μg/L, or alternately less than about 1 μg/L. In at least one embodiment, the chloride content of water feed 204 is less than about 1 μg/L. The silica content of water feed 204 can be less than about 5 μg/L, alternately less than about 4 μg/L, or alternately less than about 3 μg/L. In at least one embodiment, the silica content of water feed 204 is less than about 3 μg/L. In at least one embodiment, water feed 204 is a boiler feed water.

Optionally, water feed 204 can be passed to pump 102. Pump 102 can be any type of pump capable of increasing the pressure of water feed 204. In at least one embodiment, pump 102 is a diaphragm metering pump. The pressure of water feed 204 can be increased in pump 102 to produce water stream 206. In some embodiments, the pressure of water stream 206 can be greater than the critical pressure of water. The pressure of water stream 206 can range between about 5 bar and about 25 bar, alternately between about 16 bar and about 23 bar, or alternately between about 18 bar and about 20 bar. In at least one embodiment, the pressure of water stream 206 is about 17.9 bar.

Optionally, hydrocarbon feed 202 and water stream 206 can be passed to heat exchanger 104 such that hydrocarbon feed 202 is cooled and water stream 206 is heated. Heat exchanger 104 can be any type of heat exchanger capable of decreasing the temperature of hydrocarbon feed 202 and increasing the temperature of water stream 206. Non-limiting examples of heat exchanger 104 can include a cross exchanger. The temperature of hydrocarbon feed 202 can be decreased in heat exchanger 104 to produce hydrocarbon stream 208. The temperature of hydrocarbon stream 208 can range between about 80 deg. C. and about 370 deg. C., alternately between about 90 deg. C. and about 350 deg. C., or alternately between about 100 deg. C. and about 340 deg. C. In at least one embodiment, the temperature of hydrocarbon stream 208 is about 110 deg. C. The temperature of water stream 206 can be increased in heat exchanger 104 to produce water stream 210. The temperature of water stream 210 can range between about 200 deg. C. and about 600 deg. C., alternately between about 370 deg. C. and about 600 deg. C., or alternately between about 390 deg. C. and about 450 deg. C. In at least one embodiment, the temperature of water stream 210 is about 430 deg. C. The temperature of water stream 210 generally corresponds to the operating temperature of aqueous reformer 126 (described infra), which can be adjusted depending on certain operating parameters such as feed properties, recycle ratio, and water-to-oil ratio. The pressure of water stream 210 can range between about 5 bar and about 25 bar, alternately between about 16 bar and about 23 bar, or alternately between about 18 bar and about 20 bar. In at least one embodiment, the pressure of water stream 210 is about 17.9 bar.

Optionally, water stream 210 can include supercritical water. Supercritical water has unique properties making it suitable for use as a petroleum reaction medium where the reaction objectives can include conversion reactions, desulfurization reactions denitrogenation reactions, and demetallization reactions. Supercritical water is water at a temperature at or greater than the critical temperature of water and at a pressure at or greater than the critical pressure of water. The critical temperature of water is 373.9 deg. C. The critical pressure of water is 220.6 bar. Advantageously, at supercritical conditions water acts as both a hydrogen source and a solvent (diluent) in conversion reactions, desulfurization reactions and demetallization reactions and a catalyst is not needed. Hydrogen from the water molecules is transferred to the hydrocarbons through direct transfer or through indirect transfer, such as the water gas shift reaction.

Optionally, water stream 210 can be passed to splitter 122 to separate excess water via water stream 238 and to produce water stream 240. Splitter 122 can be any type of separation device capable of separating water stream 210 into water stream 238 and water stream 240. The temperature of water stream 240 can range between about 200 deg. C. and about 600 deg. C., alternately between about 370 deg. C. and about 600 deg. C., or alternately between about 390 deg. C. and about 450 deg. C. In at least one embodiment, the temperature of water stream 240 is about 430 deg. C. The pressure of water stream 240 can range between about 5 bar and about 25 bar, alternately between about 16 bar and about 23 bar, or alternately between about 18 bar and about 20 bar. In at least one embodiment, the pressure of water stream 240 is about 17.9 bar.

Surfactant feed 212 is passed to mixer 106 along with surfactant medium stream 214 to produce surfactant stream 216. Surfactant medium stream 214 can be a separated portion of distillate stream 260 (described infra). Surfactant feed 212 includes a readily available surfactant. The surfactant can be a non-ionic surfactant or an ionic surfactant. Non-limiting examples of the non-ionic surfactant include ethoxylated normal, iso- and cyclo-alkyl alcohols, ethoxylated phenols, ethoxylated alkyl phenols such as octyl, nonyl and dodecyl-alkyl phenols, various epoxide block co-polymerizations of ethylene oxide with other alkoxylates, including propylene oxide and butylene oxide, and fatty alcohols. Non-limiting examples of the ionic surfactant include cationic surfactants including erucyl bis(hydroxyethyl) methyl ammonium chloride, tributyl hexadecyl phosphonium bromide, trioctyl methyl ammonium chloride, cetyl trimethyl ammonium salicylate, erucyl trimethyl ammonium chloride, oleyl methyl bis(hydroxyethyl) ammonium chloride, erucyl amidopropyl trimethylamine chloride, octadecyl methyl bis(hydroxyethyl) ammonium bromide, octadecyl tris(hydroxyethyl) ammonium bromide, and octadecyl dimethyl hydroxyethyl ammonium bromide. Non-limiting examples of the ionic surfactant include anionic surfactants including alkyl sulfates, alkyl ether sulfates, alkyl ester sulfonates, alpha olefin sulfonates, linear alkyl benzene sultanates, branched alkyl benzene sulfonates, alkyl benzene sulfonic acids, sulfosuccinates, sulfated alcohols, alkoxylated sulfated alcohols, alcohol sultanates, alkoxylated alcohol sultanates, alcohol ether sulfates, and alkoxylated alcohol ether sulfates. The surfactant can have a hydrophilic-lipophilic balance (HLB) value ranging between about 3 and about 11, alternately between about 5 and about 9, or alternately between about 6 and about 8. In at least one embodiment, the HLB value of the surfactant is about 8. One skilled in the relevant art would recognize that the HLB value of the surfactant can be adjusted by selecting a suitable surfactant for forming a catalytic emulsion. Mixer 106 can be any type of mixing device capable of mixing surfactant feed 212 and surfactant medium stream 214. Non-limiting examples of mixing devices suitable for use as mixer 106 can include a static mixer, an inline mixer, and impeller-embedded mixer. The mass flow rates of surfactant feed 212 and surfactant medium stream 214 can be adjusted such that surfactant stream 216 has a surfactant content ranging between about 0.001 wt. % and about 20 wt. %, alternately between about 0.005 wt. % and about 10 wt. %, or alternately between about 0.01 wt. % and about 5 wt. %. In at least one embodiment, surfactant stream 216 has a surfactant content of about 3 wt. %. In alternate embodiments, surfactant stream 216 includes surfactant feed 212 in the absence of surfactant medium stream 214, for example when the process 100 is initiated where distillate stream 260 has not been produced. Still in alternate embodiments, surfactant stream 216 includes surfactant medium stream 214 in the absence of surfactant feed 212, for example when the process 100 no longer requires additional quantities of the surfactant. The pressure and temperature of surfactant stream 216 can depend on the temperatures and pressures of surfactant feed 212 and surfactant medium stream 214. The temperatures of surfactant feed 212, surfactant medium stream 214, and surfactant stream 216 can range between about 20 deg. C. and about 80 deg. C., alternately between about 20 deg. C. and about 60 deg. C., or alternately between about 30 deg. C. and about 50 deg. C. In at least one embodiment, the temperatures of surfactant feed 212, surfactant medium stream 214, and surfactant stream 216 are about 40 deg. C. The pressures of surfactant feed 212, surfactant medium stream 214, and surfactant stream 216 can range between about 0.1 bar and about 10 bar, alternately between about 0.5 bar and about 5 bar, or alternately between about 1 bar and about 3 bar. In at least one embodiment, the pressures of surfactant feed 212, surfactant medium stream 214, and surfactant stream 216 are about 2.03 bar. The water content of surfactant stream 216 depends on the water contents of surfactant feed 212 and surfactant medium stream 214. In some embodiments, the water content of surfactant stream 216 can be less than about 0.05 wt. % of the hydrocarbon weight.

Hydrocarbon stream 208 and surfactant stream 216 are passed to mixer 108 to produce first precursor stream 218. Mixer 108 can be any type of mixing device capable of mixing hydrocarbon stream 208 and surfactant stream 216. Non-limiting examples of mixing devices suitable for use as mixer 108 can include a static mixer, an inline mixer, and impeller-embedded mixer. First precursor stream 218 has a surfactant content ranging between about 0.00001 wt. % and about 2 wt. % of the hydrocarbon weight, alternately between about 0.00005 wt. % and about 1 wt. % of the hydrocarbon weight, or alternately between about 0.0001 wt. % and about 0.05 wt. % of the hydrocarbon weight. In at least one embodiment, first precursor stream 218 has a surfactant content of about 0.03 wt. % of the hydrocarbon weight. The temperature of first precursor stream 218 can range between about 80 deg. C. and about 370 deg. C., alternately between about 90 deg. C. and about 350 deg. C., or alternately between about 100 deg. C. and about 340 deg. C. In at least one embodiment, the temperature of first precursor stream 218 is about 100 deg. C. The pressure of first precursor stream 218 can range between about 0.1 bar and about 10 bar, alternately between about 0.5 bar and about 5 bar, or alternately between about 1 bar and about 3 bar. In at least one embodiment, the pressure of first precursor stream 218 is about 2 bar. The water content of first precursor stream 218 depends on the water contents of hydrocarbon stream 208 and surfactant stream 216. In some embodiments, the water content of first precursor stream 218 can range between about 0.02 wt. % and about 0.03 wt. % of the hydrocarbon weight.

Optionally, first precursor stream 218 can be passed to pump 110. Pump 110 can be any type of pump capable of increasing the pressure of first precursor stream 218. In at least one embodiment, pump 110 is a diaphragm metering pump. The pressure of first precursor stream 218 can be increased in pump 110 to produce first precursor stream 220. The pressure of first precursor stream 220 can range between about 5 bar and about 25 bar, alternately between about 16 bar and about 23 bar, or alternately between about 18 bar and about 20 bar. In at least one embodiment, the pressure of first precursor stream 220 is about 17.9 bar.

Alkali feed 222 and first precursor stream 220 are passed to mixer 112 to produce second precursor stream 224. Alkali feed 222 includes an aqueous solution of an alkali metal salt. The alkali metal salt can include cationic forms of alkali metals such as lithium, sodium, and potassium. The alkali concentration of the aqueous solution used for alkali feed 222 ranges between about 100 parts per million (ppm) and about 2,000 ppm, alternately between about 300 ppm and about 1,500 ppm, or alternately between about 500 ppm and about 1,000 ppm. In at least one embodiment, the alkali concentration of the aqueous solution used for alkali feed 222 is about 600 ppm. Mixer 112 can be any type of mixing device capable of mixing alkali feed 222 and first precursor stream 220. Non-limiting examples of mixing devices suitable for use as mixer 112 can include a static mixer, an inline mixer, and impeller-embedded mixer. The pressure and temperature of second precursor stream 224 can depend on the temperatures and pressures of alkali feed 222 and first precursor stream 220. The temperatures of alkali feed 222 and second precursor stream 224 can range between about 80 deg. C. and about 370 deg. C., alternately between about 90 deg. C. and about 350 deg. C., or alternately between about 100 deg. C. and about 340 deg. C. In at least one embodiment, the temperatures of alkali feed 222 and second precursor stream 224 are about 100 deg. C. The pressures of alkali feed 222 and second precursor stream 224 can range between about 5 bar and about 25 bar, alternately between about 16 bar and about 23 bar, or alternately between about 18 bar and about 20 bar. In at least one embodiment, the pressures of alkali feed 222 and second precursor stream 224 are about 17.9 bar. The water content of second precursor stream 224 depends on the water contents of alkali feed 222 and hydrocarbon-surfactant stream 220. In some embodiments, the water content of second precursor stream 224 can range between about 1 wt. % and about 20 wt. % of the hydrocarbon weight, alternately between about 1 wt. % and about 10 wt. % of the hydrocarbon weight, or alternately between about 1 wt. % and about 8 wt. % of the hydrocarbon weight. In at least one embodiments, the water content of second precursor stream 224 is about 1.75 wt. % of the hydrocarbon weight.

Transition metal feed 226 and second precursor stream 224 are passed to mixer 114 to produce catalytic emulsion stream 228. Transition metal feed 226 includes an aqueous solution of a transition metal salt. The transition metal salt can include cationic forms of transition metals such as Group 4 metals, Group 5 metals, Group 6 metals, Group 7 metals, Group 8 metals, Group 9 metals, Group 10 metals, Group 11 metals, and Group 12 metals. Non-limiting examples of transition metals include vanadium, chromium, molybdenum, tungsten, manganese, iron cobalt, nickel, palladium, copper, and zinc. The transition metal concentration of the aqueous solution used for transition metal feed 226 ranges between about 10 ppm and about 1,000 ppm, alternately between about 50 ppm and about 800 ppm, or alternately between about 100 ppm and about 500 ppm. In at least one embodiment, the transition metal concentration of the aqueous solution used for transition metal feed 226 is about 300 ppm. Mixer 114 can be any type of mixing device capable of mixing transition metal feed 226 and second precursor stream 224. Non-limiting examples of mixing devices suitable for use as mixer 114 can include a static mixer, an inline mixer, and impeller-embedded mixer. The pressure and temperature of catalytic emulsion stream 228 depend on the temperatures and pressures of transition metal feed 226 and second precursor stream 224. The temperatures of transition metal feed 226 and catalytic emulsion stream 228 can range between about 80 deg. C. and about 370 deg. C., alternately between about 90 deg. C. and about 350 deg. C., or alternately between about 100 deg. C. and about 340 deg. C. In at least one embodiment, the temperatures of transition metal feed 226 and catalytic emulsion stream 228 are about 100 deg. C. The pressures of transition metal feed 226 and catalytic emulsion stream 228 can range between about 5 bar and about 25 bar, alternately between about 16 bar and about 23 bar, or alternately between about 18 bar and about 20 bar. In at least one embodiment, the pressures of transition metal feed 226 and catalytic emulsion stream 228 are about 17.9 bar. The water content of catalytic emulsion stream 228 depends on the water contents of transition metal feed 226 and second precursor stream 224. The water content of catalytic emulsion stream 228 can range between about 1 wt. % and about 20 wt. % of the hydrocarbon weight, alternately between about 1 wt. % and about 10 wt. % of the hydrocarbon weight, or alternately between about 3 wt. % and about 8 wt. % of the hydrocarbon weight. In at least one embodiment, the water content of catalytic emulsion stream 228 is about 5 wt. % of the hydrocarbon weight.

Catalytic emulsion stream 228 includes an emulsion having heavy hydrocarbons, the surfactant, water, the alkali metal, and the transition metal. The emulsion can have an alkali metal-to-transition metal ratio ranging between about 10:1 and about 1:1 or alternately between about 5:1 and about 2:1. In at least one embodiment, the emulsion has an alkali metal-to-transition metal ratio of about 2:1. The emulsion can be a water-in-oil (w/o) emulsion or an oil-in-water (o/w) emulsion.

Optionally, catalytic emulsion stream 228 and effluent stream 246 (described infra) can be passed to heat exchanger 116 such that effluent stream 246 is cooled and catalytic emulsion stream 228 is heated. Heat exchanger 116 can be any type of heat exchanger capable of decreasing the temperature of effluent stream 246 and increasing the temperature of catalytic emulsion stream 228. Non-limiting examples of heat exchanger 116 can include a cross exchanger. The temperature of catalytic emulsion stream 228 can be increased in heat exchanger 116 to produce catalytic emulsion stream 230. The temperature of catalytic emulsion stream 230 can range between about 100 deg. C. and about 450 deg. C., alternately between about 130 deg. C. and about 430 deg. C., or alternately between about 250 deg. C. and about 400 deg. C. In at least one embodiment, the temperature of catalytic emulsion stream 230 is about 360 deg. C. The temperature of effluent stream 246 can be decreased in heat exchanger 116 to produce effluent stream 248.

Catalytic emulsion stream 230 is passed to heater 118 such that catalytic emulsion stream 230 is heated to produce catalytic suspension stream 232. Heater 118 can be any type of heater capable of increasing the temperature of catalytic emulsion stream 230. The alkali and transition metal containing emulsion included in the catalytic emulsion stream 232 is decomposed such that a catalytic suspension is produced. Non-limiting examples of heater 118 can include an electric heater, a fired heater, a furnace, and a cross exchanger. The temperature of catalytic suspension stream 232 can range between about 360 deg. C. and about 450 deg. C., alternately between about 370 deg. C. and about 430 deg. C., or alternately between about 390 deg. C. and about 430 deg. C. In at least one embodiment, the temperature of catalytic suspension stream 232 is about 430 deg. C. In some embodiments, components of the catalytic emulsion stream 230 are decomposed by application of heat via heater 118 converting the catalytic emulsion to a catalytic suspension. The conversion from catalytic emulsion to catalytic suspension occurs throughout heater 118, catalytic suspension stream 232, and separator 120.

Catalytic suspension stream 232 is introduced to separator 120. Separator 120 can be any type of separation device capable of separating a fluid stream into a gas phase stream and a liquid phase stream. Upon decomposition en route to produce the catalytic suspension, water is substantially removed along with the decomposed surfactant, which leave at the top of separator 120. As a result, catalytic metal particulates (that are, alkali and transition metals included in the catalytic emulsion) are suspended in the heavy hydrocarbons forming a catalytic suspension that leaves the bottom of separator 120. The catalytic metal particulates have a diameter ranging between about 100 nanometers and about 1.5 microns. The catalytic suspension can have a catalytic metal particulate concentration ranging between about 10 ppm and about 100,000 ppm or alternately between about 100 ppm and about 10,000 ppm. Separator 120 can be operated at a temperature ranging between about 200 deg. C. and about 600 deg. C., alternately between about 250 deg. C. and about 500 deg. C., or alternately between about 300 deg. C. and about 450 deg. C. In at least one embodiment, separator 120 is operated at a temperature of about 430 deg. C. Separator 120 can be operated at a pressure ranging between about 5 bar and about 25 bar, alternately between about 16 bar and about 23 bar, or alternately between about 18 bar and about 20 bar. In at least one embodiment, separator 120 is operated at a pressure of about 17.9 bar. The residence time in separator 120 can range between about 1 minute (min) and about 25 min, alternately between about 1 min and about 20 min, or alternately between about 2 min and about 15 min. Gaseous water and other decomposition gases (including the decomposed surfactant) are collected via gas stream 234. The catalytic suspension is collected via catalytic suspension stream 236. In this manner, the heavy hydrocarbons contained in the catalytic suspension are prepared for upgrading via aqueous reforming. In some embodiments, catalytic suspension stream 236 is substantially in the absence of the surfactant. In some embodiments, catalytic suspension stream 236 has a surfactant content less than about 0.001 wt. %.

Catalytic suspension stream 236 and water stream 240 are passed to mixer 124 to produce aqueous reformer feed 242. Mixer 124 can be any type of mixing device capable of mixing catalytic suspension stream 236 and water stream 240. Non-limiting examples of mixing devices suitable for use as mixer 124 can include a static mixer, an inline mixer, and impeller-embedded mixer. The pressure and temperature of aqueous reformer feed 242 depends on the temperatures and pressures of catalytic suspension stream 236 and water stream 240. The temperature of aqueous reformer feed 242 can range between about 200 deg. C. and about 600 deg. C., alternately between about 370 deg. C. and about 500 deg. C., or alternately between about 390 deg. C. and about 450 deg. C. In at least one embodiment, the temperature of aqueous reformer feed 242 is about 430 deg. C. The pressure of aqueous reformer feed 242 can range between about 5 bar and about 25 bar, alternately between about 16 bar and about 23 bar, or alternately between about 18 bar and about 20 bar. In at least one embodiment, the pressure of aqueous reformer feed 242 is about 17.9 bar. The water content of aqueous reformer feed 242 can range between about 1 wt. % and about 20 wt. % of the hydrocarbon weight, alternately between about 1 wt. % and about 10 wt. % of the hydrocarbon weight, or alternately between about 3 wt. % and about 8 wt. % of the hydrocarbon weight. In at least one embodiment, the water content of aqueous reformer feed 242 is about 5 wt. % of the hydrocarbon weight. In at least one embodiment, the mass flow rate of water stream 240 is about $6.755\times10^3$ kilograms per hour (kg/hr). In at least one embodiment, the mass flow rate of aqueous reformer feed 242 is about $1.505\times10^5$ kg/hr.

Aqueous reformer feed 242 is introduced to aqueous reformer 126 for upgrading the heavy hydrocarbons via aqueous reforming. Aqueous reformer 126 can be any type of reactor capable of allowing conversion reactions. Non-limiting examples of reactors suitable for use in aqueous reforming can include open tubular-type, vessel-type, and CSTR-type. In at least one embodiment, aqueous reformer 126 is an open tubular reactor, which advantageously prevents precipitation of reactants or products in the reactor. Aqueous reformer 126 can include an upflow reactor, a downflow reactor, and a horizontal flow reactor. In at least one embodiment, aqueous reformer 126 is in the absence of an external supply of catalyst. Advantageously, the use of unsupported catalysts incorporated in the catalytic suspension can reduce any pore plugging issues that are typically associated with supported heterogeneous catalysts. The active sites of the submicronic dispersed catalytic metal particulates can adsorb to the bulky heavy hydrocarbon molecules such that diffusion control can be reduced while contact time can be improved. In addition, heat gradients can be reduced to assure the isothermisity of the aqueous reforming process. In at least one embodiment, aqueous reformer 126 is in the absence of an external supply of hydrogen. The product of the aqueous reforming process is collected via effluent stream 246.

The temperature in aqueous reformer 126 can be maintained ranging between about 200 deg. C. and about 600 deg. C., alternately between about 370 deg. C. and about 500 deg. C., or alternately between about 390 deg. C. and about 450 deg. C. In at least one embodiment, the temperature in aqueous reformer 126 is maintained at about 430 deg. C. The pressure in aqueous reformer 126 can be maintained at a pressure ranging between about 5 bar and about 300 bar, alternately between about 16 bar and about 290 bar, or alternately between about 18 bar and about 270 bar. In at least one embodiment, the pressure in aqueous reformer 126 is maintained at about 17.9 bar. The residence time in aqueous reformer 126 can be between about 10 seconds (s) and about 60 min or alternately between about 1 min and about 30 min. In some embodiments, aqueous reformer 126 can be operated under supercritical conditions of water.

Without being bound by any theory, the submicronic dispersed catalytic metal particulates promote homolytic splitting of water at a pressure ranging between about 18 bar and about 24 bar to trigger certain conversion reactions. In addition, the submicronic dispersed catalytic metal particulates promote hydrogen transfer from water to the heavy hydrocarbons, reducing the viscosity of and upgrading the heavy hydrocarbons. For example, when the catalytic suspension is subjected to a temperature equal to or greater than about 430 deg. C., the submicronic dispersed catalytic metal particulates can dissociate steam into hydrogen, oxygen, and hydroxyl radicals such that the radicals can reacted with thermally cracked hydrocarbon radicals. In this manner, certain condensation reactions leading to asphaltenes and coke deposition can be suppressed such that lighter hydrocarbons can be produced.

Without being bound by any theory, the alkali and transition metals promote water dissociation into hydrogen, oxygen, and hydroxyl radicals. In addition, the transition metal reduces certain condensation reactions by promoting hydrogen addition to the hydrocarbon free radicals that are produced by homolytic cleavage of covalent bonds of the heavy hydrocarbon molecules.

Effluent stream 248, optionally cooled by heat exchanger 116, can have a temperature ranging between about 300 deg. C. and about 400 deg. C., alternately between about 320 deg. C. and about 380 deg. C., or alternately between about 340 deg. C. and about 360 deg. C. In at least one embodiment, the temperature of effluent stream 248 is about 350 deg. C.

Effluent stream 248 is passed to pressure reducer 128 to produce effluent stream 250. Pressure reducer 128 can be any type of device capable of reducing the pressure of a fluid stream. Non-limiting examples of pressure reducer 128 can include a pressure let-down valve, a pressure control valve, and a back pressure regulator. The pressure of effluent stream 248 is reduced such that the pressure of effluent stream 250 can range between about 0.1 bar and about 10 bar, alternately between about 0.5 bar and about 5 bar, or alternately between about 1 bar and about 3 bar. In at least one embodiment, the pressure of effluent stream 250 is about 2 bar.

Effluent stream 250 is introduced to separator 130. Separator 130 can be any type of separation device capable of separating a fluid stream into a gas phase stream and a liquid phase stream. Separator 130 can be operated at a temperature ranging between about 200 deg. C. and about 600 deg. C., alternately between about 250 deg. C. and about 500 deg. C., or alternately between about 300 deg. C. and about 400 deg. C. In at least one embodiment, separator is operated at a temperature of about 350 deg. C. Separator 130 can be operated at a pressure ranging between about 0.1 bar and about 10 bar, alternately between about 0.5 bar and about 5 bar, or alternately between about 1 bar and about 3 bar. In at least one embodiment, separator 130 can be operated at a pressure of about 2 bar. The residence time in separator 130 can range between about 1 min and about 25 min, alternately between about 1 min and about 20 min, or alternately between about 2 min and about 15 min. Effluent stream 250 is separated to produce heavy stream 252 and light stream 254. Heavy stream 252 can include an atmospheric residue fraction or a vacuum residue fraction, or both. Heavy stream 252 can include a distillate fraction including naphtha, kerosene, and diesel. In some embodiments, heavy stream 252 can include the alkali and transition metal-based catalytic metal particulates. Light stream 254 can include water, a gas fraction, and a distillate fraction. In some embodiments, light stream 254 is substantially in the absence of the alkali and transition metal-based catalytic metal particulates.

Optionally, light stream 254 can be passed to heat exchanger 132 such that light stream 254 is cooled. Heat exchanger 132 can be any type of heat exchange device capable of reducing the temperature of light stream 254. Non-limiting examples of heat exchanger 132 can include double pipe type exchanger and shell-and-tube type exchanger. The temperature of light stream 254 can be reduced in heat exchanger 132 to produce light stream 256. The temperature of light stream 256 can range between about 0 deg. C. and about 80 deg. C., alternately between about 20 deg. C. and about 60 deg. C., or alternately between about 30 deg. C. and about 50 deg. C. In at least one embodiment, the temperature of light stream 256 is about 40 deg. C.

Light stream 256 is introduced to separator 134. Separator 134 can be any type of separation device capable of separating a fluid stream into a gas phase stream, a liquid hydrocarbon-containing stream, and a water stream. In some embodiments, separator 134 is a combination of a gas-liquid separator and an oil-water separator. Separator 134 can be operated at a temperature ranging between about 0 deg. C. and about 80 deg. C., alternately between about 20 deg. C. and about 60 deg. C., or alternately between about 30 deg. C. and about 50 deg. C. In at least one embodiment, separator 134 is operated at a temperature of about 40 deg. C. Separator 134 can be operated at a pressure ranging between about 0.1 bar and about 10 bar, alternately between about 0.5 bar and about 5 bar, or alternately between about 1 bar and about 3 bar. In at least one embodiment, separator 134 is operated at a pressure of about 2 bar. The residence time in separator 134 can range between about 1 min and about 25 min, alternately between about 1 min and about 20 min, or alternately between about 2 min and about 15 min. Light stream 256 is separated to produce gas stream 258, distillate stream 260, and water stream 262. The gas stream 258 can include a hydrocarbon gas fraction. Distillate stream 260 can include a hydrocarbon gas fraction and a distillate fraction including naphtha, kerosene, and diesel. The liquid phase hydrocarbon distillate fraction can have a viscosity ranging between about 0.4 centiStokes (cSt) and about 125 cSt at 50 deg. C. Water is substantially removed and collected via water stream 262.

Distillate stream 260 is passed to splitter 136. Splitter 136 can be any type of separation device capable of separating distillate stream 260 into surfactant medium stream 214 and distillate stream 262. A portion of distillate stream 260 is separated to produce surfactant medium 214. The remaining portion of distillate stream 260 is collected via distillate stream 262.

Example

The disclosure is illustrated by the following example, which is presented for illustrative purposes only, and is not intended as limiting the scope of the invention which is defined by the appended claims.

An aqueous reforming system having a configuration similar to FIGURE was modelled using the HYSYS Hydroprocessing Model (Aspen Technology, Inc., Bedford, Mass.). In reference to the properties of the streams for EXAMPLE, the description and stream numbers for FIGURE is used.

A heavy hydrocarbon (stream 202) was introduced into the respective system at a mass flow rate of about 135,100 kg/hr. A surfactant composition (stream 212) was introduced into the respective system at a mass flow rate of about 41 kg/hr. The surfactant composition included paraffinic, naphthenic, and aromatic compounds functionalized with carboxylic acid groups. The surfactant composition included between about 15 wt. % and about 20 wt. % aromatic carboxylic acids. The surfactant composition included between about 10 wt. % and about 15 wt. % fatty acids. The surfactant composition included non-functionalized paraffinic, naphthenic, and aromatic fractions. The surfactant composition was combined with a surfactant medium (stream 214) separated from a distillate product (stream 260) to produce a surfactant stream (stream 216). The surfactant medium had a mass flow rate of about 1,351 kg/hr. The surfactant stream had a surfactant content of about 3 wt. %. The heavy hydrocarbon and the surfactant stream were combined to form a hydrocarbon-surfactant stream (stream 218). The pressure of the hydrocarbon-surfactant stream was maintained at about 2.027 bar. The temperature of the hydrocarbon-surfactant stream was maintained at about 40 deg. C. The pressure of the hydrocarbon-surfactant stream was increased to about 18.94 bar (stream 220). An aqueous alkali solution (stream 222) was introduced into the respective system at a mass flow rate of about 3,379 kg/hr. The aqueous alkali solution and the hydrocarbon-surfactant stream were combined to form a hydrocarbon-surfactant-alkali stream (stream 224). The pressure of the hydrocarbon-surfactant-alkali stream was maintained at about 18.94 bar. The temperature of the hydrocarbon-surfactant-alkali stream was maintained at about 40 deg. C. An aqueous transition metal solution (stream 226) was introduced into the respective system at a mass flow rate of about 3,379 kg/hr. The aqueous transition metal solution and the hydrocarbon-surfactant-alkali stream were combined to form a catalytic emulsion (stream 228) having a mass flow rate of about 143,300 kg/hr. The pressure of the catalytic emulsion was maintained at about 18.94 bar. The catalytic emulsion was passed to a heat exchanger (unit 116) where the temperature was increased to about 110 deg. C. (stream 230). The catalytic emulsion was passed to a heater (unit 118) where the temperature was further increased to about 430 deg. C. to form a catalytic suspension (stream 232). The catalytic suspension was introduced to a separator (unit 120) where water and the decomposed surfactant were collected at the top (stream 234) of the separator having a mass flow rate of about 41 kg/hr. The remaining catalytic suspension was collected at the bottom (stream 236) of the separator having a mass flow rate of about 143,300 kg/hr. The catalytic suspension was substantially in the absence of the surfactant, either decomposed or intact. The separator was maintained at a pressure of about 18.94 bar. The separator was maintained at a temperature of about 430 deg. C. Water (stream 204) was introduced into the respective system at a mass flow rate of about 60,000 kg/hr. The water was demineralized water and had a conductivity of less than about 0.2 S/cm, a sodium content ranging between 0.1 μg/L and about 2.0 μg/L, a chloride content of less than about 1 μg/L, and a silica content of less than about 3 μg/L. The water was pressurized to about 18.94 bar (stream 206). The water was heated to about 430 deg. C. (stream 210). The mass flow rate of the water (stream 240) to be combined with the catalytic suspension was about $6.755\times10^3$ kg/hr. The catalytic suspension and the water were combined to form the aqueous reformer feed (stream 242) having a mass flow rate of $1.501\times10^5$ kg/hr. The pressure of the aqueous reformer feed was maintained at about 18.94 bar. The temperature of the aqueous reformer feed was maintained at about 430 deg. C. The aqueous reformer feed was introduced into an aqueous reformer (unit 126) producing an effluent stream (stream 246) having a mass flow rate of $1.501\times10^5$ kg/hr. The temperature of the effluent stream exiting the aqueous reformer was about 430 deg. C. The effluent stream was passed to a heat exchanger (unit 116) where the temperature was decreased to about 350 deg. C. (stream 248). The pressure of the effluent stream was reduced to about 2.027 bar (stream 250). The effluent stream was introduced into a separator (unit 130) producing a heavy product (stream 252) and a light product (stream 254). The separator was operated at a pressure of about 2.027 bar. The separator was operated at a temperature of about 350 deg. C. The heavy product had a mass flow rate of about $7.698\times10^4$ kg/hr. The light product had a mass flow rate of about $7.312\times10^4$ kg/hr. The temperature of the light product was reduced to about 40 deg. C. (stream 256). The light product was introduced into a separator (unit 134) producing a gas product (stream 258), the distillate product (stream 260), and water (stream 262). The separator was operated at a pressure of about 2.027 bar. The separator was operated at a temperature of about 40 deg. C. The liquid phase distillate product had a mass flow rate of about $5.963\times10^4$ kg/hr. A portion of the distillate product was separated and used as the surfactant medium (stream 214) having a mass flow rate of about 1,351 kg/hr. The surfactant medium replaced the surfactant composition (stream 212) used in the initial run.

The properties of the streams for EXAMPLE are provided in Table 1.

TABLE 1

| Stream No. | Temperature (deg. C.) | Pressure (bar) | Mass Flow Rate (kg/hr) |
|---|---|---|---|
| 208 | 40.00 | 2.027 | 135,100 |
| 212 | 40.00 | 2.027 | 41 |
| 214 | 40.00 | 2.027 | 1,351 |
| 218 | 40.00 | 2.027 | 136,500 |
| 220 | 40.00 | 18.94 | 136,500 |
| 222 | 40.00 | 18.94 | 3,379 |
| 224 | 40.00 | 18.94 | 139,800 |
| 226 | 40.00 | 18.94 | 3,379 |
| 228 | 40.00 | 18.94 | 143,300 |
| 230 | 110.0 | 18.94 | 143,300 |
| 232 | 430.0 | 18.94 | 143,300 |
| 234 | 430.0 | 18.94 | 41 |
| 236 | 430.0 | 18.94 | 143,300 |
| 240 | 430.0 | 18.94 | 6,755 |
| 242 | 430.0 | 18.94 | 150,100 |
| 246 | 430.0 | 18.94 | 150,100 |
| 248 | 350.0 | 18.94 | 150,100 |
| 250 | 350.0 | 2.027 | 150,100 |
| 252 | 350.0 | 2.027 | 76,980 |
| 254 | 350.0 | 2.027 | 73,120 |
| 256 | 40.00 | 2.027 | 73,120 |
| 260 | 40.00 | 2.027 | 59,630 |
| 262 | 40.00 | 2.027 | 58,270 |

The properties of the introduced heavy hydrocarbon (stream 202), the heavy product (stream 252), the gas product (stream 258), and the distillate product (stream 262) are provided in Table 2.

TABLE 2

| Property | | Heavy Hydrocarbon (Stream 202) | Heavy Product (Stream 252) | Gas Product (Stream 258) | Distillate Product (Stream 262) |
|---|---|---|---|---|---|
| Mass Flow Rate (kg/hr) | | 135,100 | 76,890 | — | 58,270 |
| API Gravity | | 5-9 | 5-7 | — | 10-24 |
| Viscosity (cP) | | 4.526 | 0.3917 | — | 1.234 |
| Gas Fraction (wt. %) | | 0 | 0 | 100 | 42.3 |
| Distillate Fraction (wt. %) | Naphtha | 0 | 1.39% of Total Distillate Fraction | 0 | 48.57 |
| | Distillates Heavier than Naphtha | 0 | 98.61% of Total Distillate Fraction | 0 | 9.34 |
| | Total | 0 | 40-80 | 0 | 57.88 |
| Atmospheric Residue Fraction (wt. %) | | 14.77 | 10-20 | 0 | 0 |
| Vacuum Residue Fraction (wt. %) | | 85.23 | 30-60 | 0 | 0 |

Further modifications and alternative embodiments of various aspects of the disclosure will be apparent to those skilled in the art in view of this description. Accordingly, this description is to be construed as illustrative only and is for the purpose of teaching those skilled in the art the general manner of carrying out the embodiments described in the disclosure. It is to be understood that the forms shown and described in the disclosure are to be taken as examples of embodiments. Elements and materials may be substituted for those illustrated and described in the disclosure, parts and processes may be reversed or omitted, and certain features may be utilized independently, all as would be apparent to one skilled in the art after having the benefit of this description. Changes may be made in the elements described in the disclosure without departing from the spirit and scope of the disclosure as described in the following claims. Headings used described in the disclosure are for organizational purposes only and are not meant to be used to limit the scope of the description.

What is claimed is:

1. An aqueous reforming system for upgrading heavy hydrocarbons, the aqueous reforming system comprising:

a first mixer, the first mixer configured to combine a hydrocarbon feed and a surfactant stream to produce a first precursor stream, wherein the hydrocarbon feed comprises the heavy hydrocarbons, wherein the surfactant stream comprises a surfactant;

a second mixer, the second mixer fluidly connected downstream of the first mixer, the second mixer configured to combine the first precursor stream and an alkali feed to produce a second precursor stream, wherein the alkali feed comprises an alkali metal and water;

a third mixer, the third mixer fluidly connected downstream of the second mixer, the third mixer configured to combine the second precursor stream and a transition metal feed to produce a catalytic emulsion stream, wherein the transition metal feed comprises a transition metal and water, wherein the catalytic emulsion stream comprises an emulsion comprising the heavy hydrocarbons, the alkali metal, the transition metal, the surfactant, and water;

a heater, the heater fluidly connected downstream of the third mixer, the heater configured to heat the catalytic emulsion stream to a first temperature ranging between 390 deg. C. and 430 deg. C. such that the surfactant is decomposed producing a suspension and a decomposition gas, wherein the suspension comprises the heavy hydrocarbons, the alkali metal, and the transition metal;

a first separator, the first separator fluidly connected downstream of the heater, the first separator configured to produce a catalytic suspension stream and a decomposition gas stream, wherein the catalytic suspension stream comprises the suspension, wherein the catalytic suspension stream is substantially in the absence of water, wherein the decomposition gas stream comprises the decomposition gas and water;

a fourth mixer, the fourth mixer fluidly connected downstream of the first separator, the fourth mixer configured to combine the catalytic suspension stream and a preheated water stream to produce an aqueous reformer feed;

an aqueous reformer, the aqueous reformer fluidly connected downstream of the fourth mixer, the aqueous reformer configured to allow the heavy hydrocarbons to undergo conversion reactions at a second temperature ranging between 390 deg. C. and 450 deg. C. to produce an effluent stream, wherein the effluent stream comprises upgraded hydrocarbons;

a second separator, the second separator fluidly connected downstream of the aqueous reformer, the second separator configured to separate the effluent stream to produce a heavy stream and a light stream, wherein the heavy stream comprises hydrocarbons having a true boiling point greater than that of the light stream; and a third separator, the third separator fluidly connected downstream of the second separator, the third separator configured to separate the light stream to produce a gas stream, a distillate stream, and a spent water stream.

2. The aqueous reforming system of claim 1, further comprising:

a splitter, the splitter fluidly connected downstream of the third separator and upstream of the first mixer, the splitter configured to separate a portion of the distillate stream, wherein the portion of the distillate stream is combined with the hydrocarbon feed and the surfactant stream to produce the first precursor stream.

3. The aqueous reforming system of claim 1, further comprising:

a pump, the pump fluidly connected downstream of the first mixer and upstream of the second mixer, the pump configured to pressurize the first precursor stream to a first pressure ranging between 15 bar and 20 bar.

4. The aqueous reforming system of claim 1, further comprising:

a pressure reducer, the pressure reducer fluidly connected downstream of the aqueous reformer and upstream of the second separator, the pressure reducer configured to depressurize the effluent stream to a second pressure ranging between 1 bar and 3 bar.

5. The aqueous reforming system of claim 1, further comprising:

a heat exchanger, the heat exchanger fluidly connected downstream of the second separator and upstream of the third separator, the heat exchanger configured to cool the light stream to a third temperature ranging between 30 deg. C. and 50 deg. C.

6. The aqueous reforming system of claim 1, wherein the first pressure is a pressure between 18 bar and 20 bar.

7. The aqueous reforming system of claim 1, wherein the first precursor stream has a surfactant content ranging between 0.0001 wt. % and 0.05 wt. %.

8. The aqueous reforming system of claim 1, wherein the heavy hydrocarbons are selected from the group consisting of: an atmospheric residue fraction, a vacuum residue fraction, and combinations thereof.

9. The aqueous reforming system of claim 1, wherein the alkali feed has an alkali metal concentration ranging between 500 ppm and 1,000 ppm.

10. The aqueous reforming system of claim 1, wherein the transition metal feed has a transition metal concentration ranging between 100 ppm and 500 ppm.

11. The aqueous reforming system of claim 1, wherein the catalytic emulsion stream has a water content ranging between 3 wt. % and 8 wt. % of the heavy hydrocarbons included therein.

12. The aqueous reforming system of claim 1, wherein the catalytic emulsion stream has an alkali metal-to-transition metal ratio ranging between 5:1 and 2:1.

13. The aqueous reforming system of claim 1, wherein the preheated water is under supercritical conditions of water.

14. The aqueous reforming system of claim 1, wherein the aqueous reformer feed has a temperature ranging between 390 deg. C. and 450 deg. C.

15. The aqueous reforming system of claim 1, wherein the aqueous reformer feed has a water content ranging between 3 wt. % and 8 wt. % of the heavy hydrocarbons included therein.

16. The aqueous reforming system of claim 1, wherein the heavy stream comprises a fraction selected from the group consisting of: an atmospheric residue fraction, a vacuum residue fraction, and combinations thereof.

17. The aqueous reforming system of claim 1, wherein the light stream comprises a distillate fraction, a gas fraction, and water.

18. The aqueous reforming system of claim 1, wherein the distillate stream comprises a fraction selected from the group consisting of: a diesel fraction, a kerosene fraction, a heavy naphtha fraction, a light naphtha fraction, and combinations thereof.

* * * * *